US006478511B1

(12) United States Patent
Hudson et al.

(10) Patent No.: US 6,478,511 B1
(45) Date of Patent: Nov. 12, 2002

(54) FLOATING SYSTEM WITH TENSIONED LINES

(75) Inventors: William Hudson, Clamart (FR); Olivier Andrieux, Issy-les-Moulineaux (FR); Jean Falcimaigne, Bois Colombes (FR); Pierre Odru, Fontenay-Sous-Bois (FR)

(73) Assignees: Institut Francais du Petrole, Rueil-Malmaison cedex (FR); Doris Engineering, Paris (FR)

( * ) Notice: Subject to any disclaimer, the term of this patent is extended or adjusted under 35 U.S.C. 154(b) by 0 days.

(21) Appl. No.: 09/564,673

(22) Filed: May 4, 2000

(30) Foreign Application Priority Data

May 4, 1999 (FR) ..... 99 05613

(51) Int. Cl.[7] ..... B63B 35/44; B63B 21/50
(52) U.S. Cl. ..... 405/223.1; 405/224; 114/264
(58) Field of Search ..... 405/224, 224.2, 405/223.1, 195.1, 224.4, 224.3; 114/264

(56) References Cited

U.S. PATENT DOCUMENTS

| | | | | | |
|---|---|---|---|---|---|
| 4,793,738 | A | * | 12/1988 | White et al. | 405/224 |
| 4,938,630 | A | * | 7/1990 | Karsan et al. | 405/224 |
| 4,983,073 | A | * | 1/1991 | Petty et al. | 405/224 |
| 5,222,453 | A | * | 6/1993 | Chabot | 114/230 |
| 5,431,511 | A | * | 7/1995 | Guy | 405/223.1 |
| 5,575,592 | A | * | 11/1996 | Pollack | 405/223.1 |
| 6,109,834 | A | * | 8/2000 | Chitwood | 405/223.1 |

FOREIGN PATENT DOCUMENTS

| | | |
|---|---|---|
| GB | 1425593 | 2/1976 |
| GB | 2092664 | 8/1982 |
| GB | 2245287 | 1/1992 |
| WO | 9839513 | 9/1998 |

OTHER PUBLICATIONS

Assessment Of Alternative Materials and Designs for TLPTethers OMAE 1988 Houston Feb. 1988 pp. 149–155XP000874519.

Ivar Fylling et al "TLP Tendon Analysis" Tension leg Platform, A State of The Art Review 1989 pp. 139–141 New York, NY XP000874470.

CP Johnson Computer Aided Design Approach For Deep Water Tension Leg Platforms XP000874449 pp. 77–78 (1994).

Cenap Oral "Overall Dynamic Characteristics Of Tension Leg Platforms" XP000874350 pp. 234–241 (1983).

Nordgren Analysis of High–Frequency Vibration of Tension Leg Platforms XP000874344 1987 pp. 119–125.

Nordgren: The Design of Tension Leg Platforms By a Constrained Optimization Method, XP000874522 1989 pp. 194–202.

Salama et al "Materials For Lightweight Mooring Systems for Deepwater Compliant Structure" Fourth International Offshore Mechanics and Arctic Engineering Symposium, 1985 ASME Energy Sources Conference Dallas Texas, vol. 2, 1985 XP00874424 table 1 p. 358.

* cited by examiner

*Primary Examiner*—Heather Shackelford
*Assistant Examiner*—Frederick L Lagman
(74) *Attorney, Agent, or Firm*—Antonelli, Terry, Stout & Kraus, LLP

(57) ABSTRACT

A floating system for very deep water includes a floating structure (1) subject to the external loadings (7, 8, 9) inducing stresses, the floating structure (1) being held in position on the sea bed by one or several tensioned lines (2) made of a material having given mechanical properties. The tensioned line or lines (2) are made of a material that is not very sensitive to fatigue stresses and the tensioned line or lines are sized in a manner independent of the fatigue phenomena associated with the dynamic behavior of the floating system under the effect of external loadings.

12 Claims, 2 Drawing Sheets

FLOATING SYSTEM WITH TENSIONED LINES

BACKGROUND OF THE INVENTION

This invention relates in particular to a platform with tensioned lines for very deep water, used in particular in the petroleum industry for exploiting marine deposits. It possesses namely as a characteristic feature tensioned lines made of a material that is not very sensitive to fatigue stresses, and which are sized independently of constraints associated with periods of excitation due to the external environmental loads (swell, wind, current), and with fatigue phenomena associated with the dynamic behavior of the said platform under the effect of these loads.

The invention is applied in the field of platforms comprising anchoring lines made of a material having a high strength, for example, special high-strength steels, or tensioned lines made of high-strength carbon fiber.

Tension leg platforms, or TLPs are floating systems used for example within the context of exploiting petroleum deposits. These floating systems possess a characteristic or main original feature in that they are fitted with a tensioned anchoring system which serves to eliminate certain movements associated with swell or tides (heave, roll and pitch). Movements such as the rotation of the vertical axis (known under the term yaw by a person skilled in the art) and horizontal displacements of limited and long-period amplitude, are authorized within certain admissible limits. The anchoring system is generally made of tendons or tensioned lines, generally of a tubular shape, arranged vertically so as to hold the platform in place on the sea bed.

Another characteristic feature of the floating system is that it is always under positive tension so as to avoid compression of the lower section of the tendons under the effect of loadings resulting from the action of swell tide or other actions due to the environment. These external loadings may induce significant tension fatigue effects which may reduce the service life of the system in the long term.

If the anchor lines are made of steel, the value of the natural period of the floating system is situated within a range of values sufficiently remote from those of the periods of external loadings.

Such a floating system comprising steel tendons is particularly well-suited to relatively deep water, of the order of 1000 meters for example.

In the case of water deeper than 1000 meters, or deeper even than 1500 to 2000 meters for example, the weight of the steel anchor lines becomes an important parameter which must be taken into account in the sizing of the tension leg platform or TLP. This consideration generally leads to the TLP being oversized.

In fact, in the case of very deep water, and under the effect of the hydrostatic pressure of circumferential crushing, the own weight of the steel tendon starts to increase significantly, inducing an increase in the displacement of the floating structure which must be sufficient to support its weight. This displacement itself leads to an increase in the loads stressing the tendons, thus requiring the thickness of the steel tendons to be increased, which again implies an increase in the movement of the floating structure and so on. This sizing process is likely to lead to a divergence in the sizing of platforms for very deep seas.

To resolve this problem a prior art is known of using tendons made of light material with high-performance mechanical properties and suitable for constraints due to the environment, whilst remaining within a range of natural periods of vibration located outside the range of periods of existing external loadings or excitations.

It would be possible to use titanium. However, this has the disadvantage in that it has inappropriate longitudinal rigidity and an unsuitable density, and is also very expensive.

Composite materials enable a good compromise to be reached between mechanical strength and the cost of the tendon. Carbon fiber, for example, offers the best advantages due to its rigidity which is close to or greater than that of steel (Young's modulus between 230 and 400 GPa, or even greater), its very low density (1.7 in air or 0.7 in water) and its very high mechanical performance (rupture strength greater than 3500 MPa accompanied by a quasi-insensitivity to fatigue and to corrosion).

SUMMARY OF THE INVENTION

This invention relates namely to a floating system for deep water comprising at least a floating structure held in place on the sea bed by means of tensioned lines, sized independently of the fatigue phenomena associated namely with the dynamic behavior of the floating structure under the effect of external loadings.

The invention relates to a floating system for deep water comprising at least a floating structure subject to external loadings (swell, wind, tide, for example) inducing stresses within the said floating system, the said floating structure being held on the sea bed by means of one or several tensioned lines made of a material having given mechanical properties.

The system is characterized in that the tensioned line or lines are made of a material which is not very sensitive to fatigue stresses and in that the tensioned line or lines are sized independently of the fatigue phenomena associated with the dynamic behavior of the floating system under the effect of external loadings. The system has several natural periods Tj, of heave $T_1$, roll $T_2$ or of pitch $T_3$, and at least one of these three values ($T_1$, $T_2$, $T_3$) is within the range of the periods Te of the external loadings, such as the wave excitation.

The system is characterieed in that the said tensioned line or lines are made of a material which is not very sensitive to fatigue stresses and in that the said tensioned line or lines are sized independently of the fatigue phenomena associated with the dynamic behavior of the said floating system under the effect of external loadings. The system has several natural periods Tj, of heave $T_1$, roll $T_2$ or of pitch $T_3$, and at least one of these three values ($T_1$, $T_2$, $T_3$) is within the range of the periods Te of the external loadings, such as the wave excitation.

The tensioned lines may be sized independently of the range of periods of excitation.

In accordance with a specific embodiment, the tensioned line or lines possess geometric characteristics such as section Si and/or diameter Di, at least one of the two characteristics being determined for example so that the stresses $\sigma i$, taking into account the dynamic amplification factor FAD acting on the tensioned line or lines are less than a maximum fixed stress $\sigma max$.

The tensioned line or lines may be made of high-strength carbon fiber.

In another specific embodiment the tensioned line or lines are for example made of steel cables with high mechanical strength.

At least one of the natural periods $T_1$, $T_2$ or $T_3$ is for example at least greater than 7 seconds and preferably located between 7 and 12 seconds inclusive.

In accordance with a specific embodiment, the tensioned line or lines are aligned in an approximately vertical direction.

According to another specific embodiment, the tensioned line or lines form for example an angle at least equal to 10° in relation to a vertical line and preferably between 10° and 45° inclusive.

The floating structure may be a marine production and/or drilling platform or even a buoy located at a distance "d" beneath the surface of the water.

According to one embodiment the marine platform is used for depths of water greater than 1000 m at least.

The invention also concerns a method for sizing one or several tensioned lines Used as a means of anchoring a floating structure, the tensioned line or lines having geometric characteristics (Si and/or Di), the tensioned line or lines being made of material resistant to fatigue.

The method is characterized in that it comprises at least the following stages:

a) At least one of the natural periods $T_1$ of heave, $T_2$ of roll, $T_3$ of pitch is chosen approximately within the range of periods Te of the wave excitation, b) a value is determined for the section Si and/or the diameter Di of the tensioned line or lines, c) depending on the external loadings to which the assembly formed by the floating structure and the said tensioned lines, force Fi is determined which acts on the tensioned line or on each of the tensioned lines, d) the value of the stress $\sigma i$, to which the tensioned line or lines are subjected, is determined, e) the value $\sigma i$ is compared with an admissible maximum value $\sigma max$, f) whereas $\sigma i$ differs from $\sigma max$, the value of section Si, and/or the value of diameter Di is varied, and stages c) to f) repeated and the value of Si and/or Di noted for $\sigma i$ approximately equal to $\sigma max$.

According to a method of calculation starting with the value of Si and/or Di and obtained during stage f), the dynamic amplification factor FAD is determined as well as the force Fd in the said tensioned line or lines, and stages d) to f) are repeated.

According to another method of calculation, the value of heave for example is determined taking into account the value of maximum stress $\sigma max$, which heave value is then compared with a tolerable value and if the heave value found exceeds the tolerable value, the value of section Si and/or the value of diameter Di of the tensioned line or lines is varied.

The method according to the invention applies for example to the sizing of tensioned lines made of high-strength composite material or of tensioned lines made of steel cables of high mechanical strength or of tensioned lines used as means of anchoring a marine platform.

The invention has the following advantages in particular:

1) the system enables the concepts currently used for production to be extended to greater depths of water, whilst keeping the costs within reasonable limits, 2) the sizing of the tensioned lines can be optimised depending on the use of the material which procures savings, 3) it reduces the influence of second-order, non-stationary phenomena associated with the vibration of the structure due to swell, known in the art as "ringing and springing".

BRIEF DESCRIPTION OF THE DRAWINGS

Other characteristics and features of the method and of the device according to the invention will emerge from reading the following description and embodiments given as a non limitative example by reference to the figures where.

DETAILED DESCRIPTION OF THE PREFERRED EMBODIMENT

Figure 1:
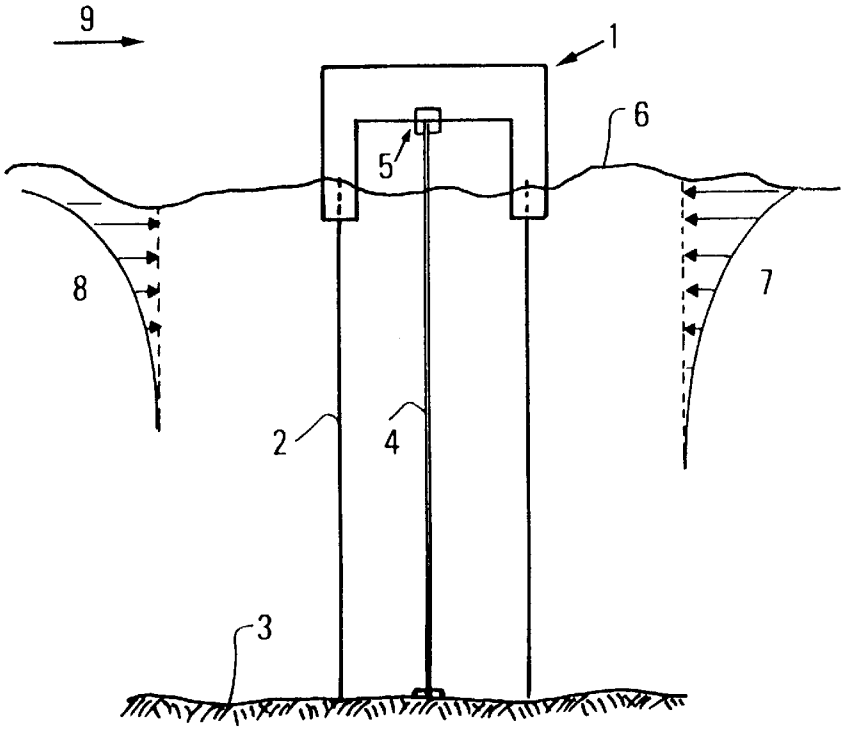
FIG. 1 is a diagram of a production system comprising a platform with tensioned lines.

FIG. 1 shows a floating structure 1 with tensioned lines such as a platform, equipped for example with four anchor lines 2, enabling the structure to be held in place on the sea bed 3. The lines are also designated tensioned lines or tendons. In this invention the tensioned lines are made for example of a material with an essential characteristic of high mechanical strength, for example at least equal to 1500 MPa and an apparent low weight (in the water).

The material used for the tensioned lines may be selected from among one of those cited in the table below which is for illustration purposes and is not exhaustive.

| | Density | Young's modulus | Mechanical strength |
|---|---|---|---|
| HR steel: | 7.8 | 200 GPa | 1800 MPa |
| HR carbon fibers: | 1.75 | 230 GPa | 3500 MPa |
| HM carbon fibers: | 1.95 | 400 GPa | 2500 MPa |

where the abbreviations
HR means high mechanical strength
HM means high Young's modulus Without departing from the scope of the invention, any material with similar mechanical characteristics can be used for the tendons. The latter may be made of twisted steel cables.

One or several risers 4 enable the effluent from the production well to be raised to the platform. The latter comprises for example wellheads 5 at the surface.

FIG. 1 also shows the surface of the sea 6 and various external loadings which act on the platform. References 7, 8 and 9 designate respectively the current, waves and wind, for example. These external loadings themselves have a period of excitation designated $T_e$ in the description.

The number of tensioned lines is selected depending for example on the dimensions and geometry of the platform, the depth of water, the environment in which the platform is located, the external loadings acting on it, the type of materials from which the tendons are made.

A tensioned line is defined for example by its characteristics and its geometric dimensions such as its length l, its section $S_i$, its external diameter $D_i$ and also by the characteristics of the material itself of which it is made, such as its mechanical strength, its Young's modulus E and its average density $\rho$.

The floating structure or platform has either a mass m, a height h, and a float surface ($S_f$) corresponding to the intersection of the volume of the hull and of the plane of the sea or water surface.

In order to recall, the methods of sizing production systems according to prior art consist of selecting a value for the natural period of vertical vibration of the platform located outside the range of periods of external excitations. For example, the value of the highest natural period is usually selected in the region of 4 seconds.

The method of sizing the tensioned lines comprises for example at least the following stages:

Given Parameters

The tensioned lines or tendons are mainly stressed by three torque components of the forces applied to the platform, the vertical component of the general resultant of the forces and the two horizontal components of the moments. These forces are amplified dynamically depending on the proximity of the frequency of external excitations and the natural frequencies of vibration of the mechanical system comprising the platform and the anchor lines. Natural vibration periods correspond to these frequencies. Three natural periods $T_j$ are thus defined, corresponding respectively to the natural period of heave $T_1$, and the natural periods of roll $T_2$ and of pitch $T_3$.

The most unfavourable natural period is the highest of the natural periods cited above. It frequently corresponds to an angular movement of roll and pitch of the anchored platform. It may also be a period corresponding to a vertical movement of heave.

The natural period $T_1$ of vertical vibration of a platform with tensioned lines is given for example by the formula:

$$T_1 = 2\pi\sqrt{\frac{m + m_a}{K_i + K_h}} \quad \text{where} \tag{1}$$

$K_H$ is the hydrostatic rigidity $K_H = pgS_f$.

the three factors of the product being respectively the volume mass of the seawater, the acceleration due to gravity and the total area of the float surface of the platform (intersection of the volume of the hull and of the plane of the surface of the ocean).

m: mass of the PLT, $m_a$: added hydrodynamic mass, $$K_i = \left(\frac{ES_i}{l}\right) \text{ global with } ES_i\text{: overall rigidity of the tensioned lines}$$

(E Young's modulus, $S_i$ section of the tendons), i is the index of a tensioned line and I its length.

It is assumed that all the tensioned lines have the same characteristics when describing the following stages of the method.

When roll or pitch is considered, formula (1) becomes for roll $$T_2 = 2\pi\sqrt{\frac{I + I_a}{K_i * d_2^2 + gma}} \quad \text{with} \tag{2}$$

l: the inertia of the platform in relation to the axis passing through its center of gravity, $l_a$: added inertia $d_2$: the distance between the axes of the tensioned lines in the perpendicular direction to the axis of rotation of the rolling movement, m: the mass of the TLP, a: the modulus of stability which may be positive or possibly slightly negative.

for pitch $$T_3 = 2\pi\sqrt{\frac{I + I_a}{K_i * d_3^2 + gma}} \quad \text{where} \tag{3}$$

$d_3$: the distance between the axes of the tensioned lines in the perpendicular direction to the axis of rotation of the pitch movement.

The various forces F acting on the platform under the effect of external loadings are also known. Part of these loads depend very much on the external diameter $D_i$ of the tensioned lines in question in accordance with the equations known to a person skilled in the art. These various forces may be deduced from a database representative of the environmental conditions to which the TLP is subjected.

Calculation of the Stress Induced in the Tendons

Initially, and once the value of section $S_i$ and/or the value of diameter $D_i$ are determined, the force $F_i$, and then the stress $\sigma_i$ induced in each of the lines or tendons by the environmental loads applied to the TLP can be calculated by applying the following equation:

$$\sigma_i = \frac{F}{S_i} \tag{4}$$

The value of the stress thus obtained is compared, for example, with the value of the strength of the material corresponding to the tendon taking a safety margin into account. The value of the stress $\sigma_{max}$, acceptable for a tensioned line or a tendon may accept, is for example determined using the equations known to a person skilled in the art, these equations linking namely the natural period to the stress.

The comparison stages are as follows, for example:

if $\sigma_i < \sigma_{max}$ the value of section $S_i$ is reduced, and the stages for calculating the induced stress and the comparison stages are repeated until a value of stress σi approximately equal to the value of stress $\sigma_{max}$ is obtained, if $\sigma_i > \sigma_{max}$ the values of section $S_i$ is increased and the stages for calculating the induced stress and the comparison stages are repeated until a value of stress approximately equal to the value of stress $\sigma_{max}$ is obtained, if $\sigma_i = \sigma_{max}$ the values of the natural periods $T_j$ of the assembly comprising the platform and the tensioned lines are then determined using one of the three formula (1), (2) or (3) given above:

formula (1) when one wishes to obtain the natural period of heave $T_1$, formula (2) for the natural period of roll $T_2$, formula (3) for the natural period of pitch $T_3$.

To recap, whilst $\sigma_i$ differs from $\sigma_{max}$ the value of section $S_i$ and/or the value of diameter $D_i$ of the tensioned lines is varied and the stages cited above for calculating the external loadings, the stresses and the comparison stages are repeated.

Calculation of the Dynamic Amplification

Once the value of section $S_i$ has been found, the factor of dynamic amplification of the forces in the tensioned line is determined, whilst ignoring the dampening, designated by the abbreviated term FAD.

The relation between the natural period of vibration $T_j$ and the maximum stress $\sigma_{max}$ acceptable for a tensioned line is the following for example:

if $T_e$ is the period of the wave excitation corresponding to the frequency of excitation $v_e$ and $T_j$ is the value of the natural period of vibration obtained in the stages explained above, the value of FAD is given by the following equation (5):

$$FAD=1/\sqrt{(1-(T_e/T_j)^2)}$$

if F is the dynamic force applied to the platform with frequency v (corresponding to the period $T_j$), the axial force corresponding to $\sigma_{max}$ *$S_i$ in the lines is:

$$F_d=F/\sqrt{(1-(T_e/T_j)^2)}$$

Value $F_d$ corresponding to the supplementary force is then used in equation (4) to re-calculate the value of the induced stress as well as a new value of section $S_i$ and the corresponding value $T_j$.

The comparison stages are repeated until an approximately constant value $T_j$ is found.

For tensioned lines having a tubular shape of external diameter $D_i$ and thickness $e_i$, which are linked with the value of section $S_i$ by formulae known to the person skilled in the art, at least one of the values $D_i$ and/or $e_i$ is varied to determine the value of the stress and the value of the natural period $T_j$ by executing the stages described above.

The sizing of the tensioned lines may comprise a supplementary stage where a check is made to see if the heave induced by external stresses is tolerable.

The value of heave of the platform or the TLP is given for example by the formula $$\Delta|=(\sigma_i*l)/E$$

This heave value is then compared to a maximum value which is fixed for example by taking into account the equipment and the platform.

If the heave value found exceeds the tolerated value, the value of the section of the tensioned lines is varied until an acceptable, pre-determined value is found.

The limits for the heave values are given for example by taking into account the various constraints, for example, protecting the well heads arranged at platform level, and subtracting them from the water.

The example shown below illustrates the advantages resulting from the use of tensioned lines of the cable type and dimensioned according to the invention. The TLP in question was sized so as to be used in environmental conditions deemed extremely severe.

| | |
|---|---|
| Depth of water | 2000 meters |
| Head load (mass of equipment borne by the hull of the platform) | 20 000 tonnes |
| Platform displacement | 62 000 tonnes |
| Range of wave excitation periods | 5 s to 25 seconds |
| Natural period of roll and pitch | 7.05 seconds |
| Number of tensioned lines | 12 |
| Material and configuration | cables made of HR carbon fiber |
| Elastic limit/admissible stress | 3500–1750 MPa |
| Young's modulus | 230 000 MPa |
| External diameter of the lines | 292 mm |
| Material section | approx. 39 500 mm$^2$ |

Figure 2:
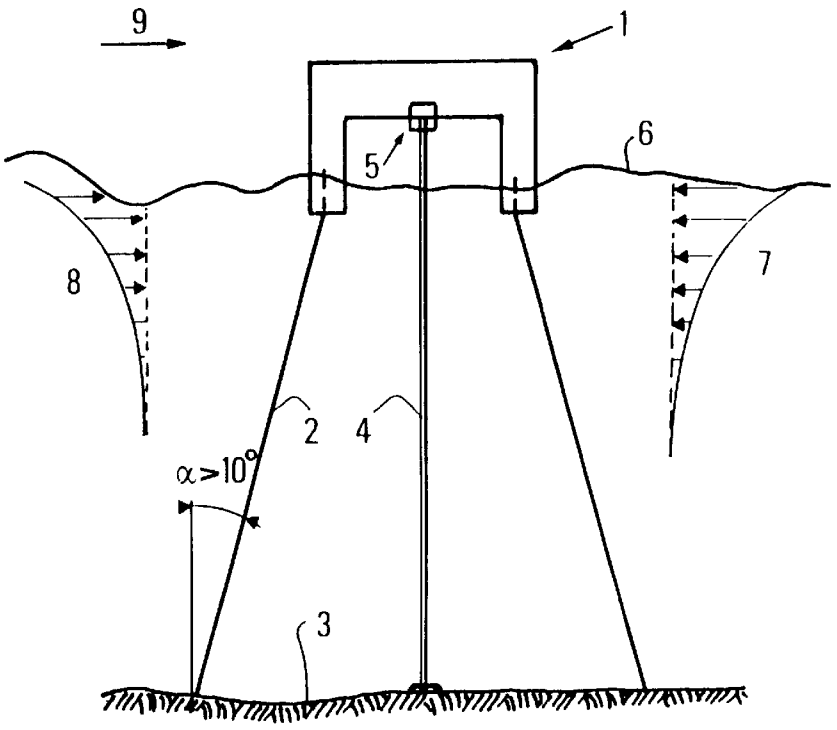
FIG. 2 shows a variant of FIG. 1 with the inclined tensioned lines.

Without departing from the scope of the invention, FIG. 2 is a diagram of an example of the use of tensioned lines dimensioned according to the invention which are inclined by an angle counted in relation to the vertical. The value of the angle is at least equal to 10° and for preferably between 10° and 45° inclusive.

Such an arrangement namely enables the horizontal or rotational movement to which the floating structure or the platform is subjected to be restrained.

The invention also relates to tensioned lines used for mooring any type of floating structure such as a floating buoy located for example at a small distance below the surface of the water, TLP's, SPAR's or any type of floating structure used in the production of petroleum.

Figure 3:
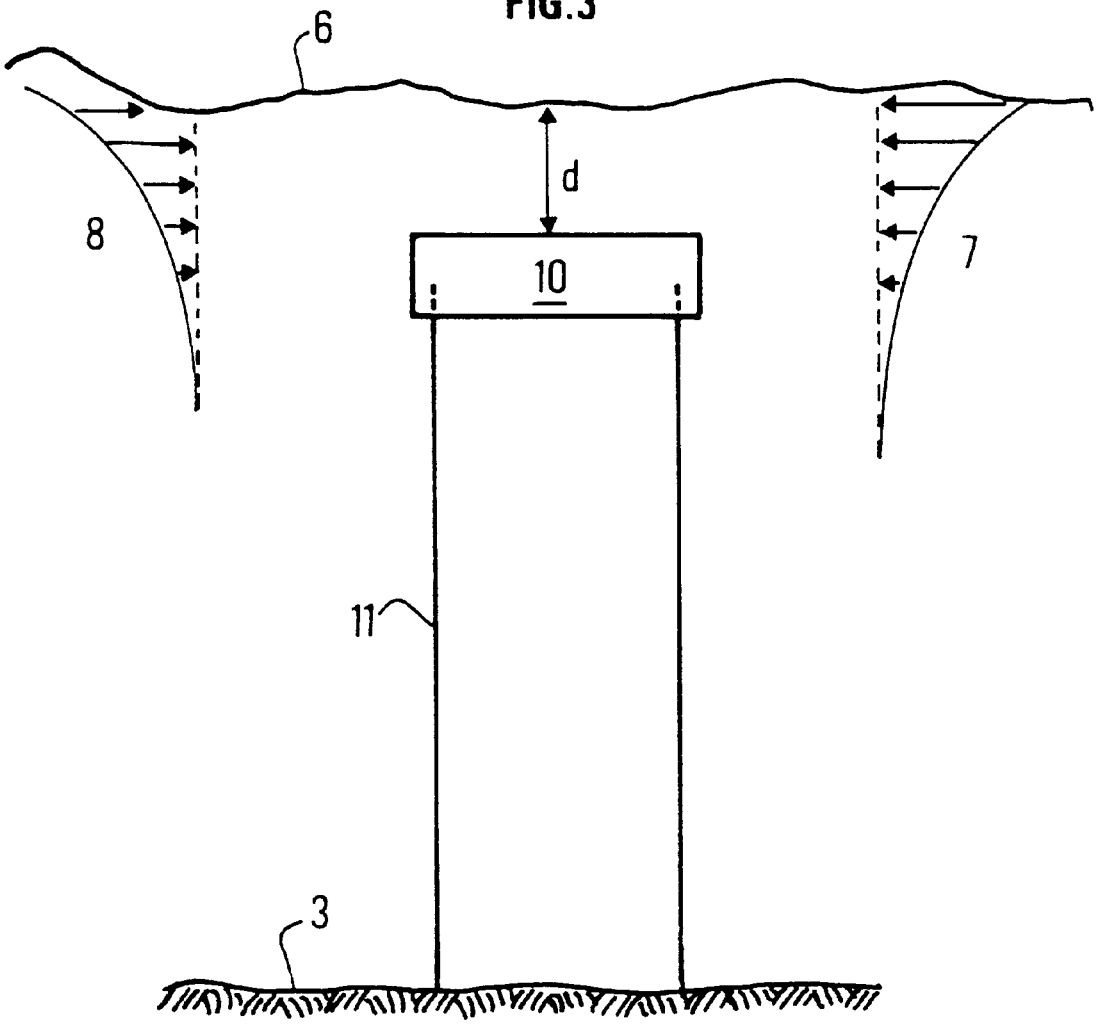
FIG. 3 is a diagram of an example of the application of the invention to floating structures located below sea level.

FIG. 3 shows for example a buoy 10 located at a distance d below the surface of the sea, the buoy being subjected to at least certain excitations cited above. The tensioned lines 11 permitting the anchoring of this buoy on the sea bed are sized in accordance with the stages of the method cited above.

The buoy may be equipped with various production means normally used for the production of petroleum for example.

What is claimed is:

1. Floating system for a very deep water comprising at least one floating structure subjected to external loadings inducing stresses within the said floating system, the said floating structure being held in position on the sea bed by means of one or several tensioned lines made of a material with given mechanical properties characterized in that: the said tensioned line or lines are made of a material not very sensitive to fatigue, the said tensioned line or lines are sized independently of the fatigue phenomena associated with the dynamic behavior of the said floating system under the effect of external loadings, and the said floating system possesses several natural periods $T_j$, of heave $T_1$, of roll $T_2$ or of pitch $T_3$, and in that at least one of these three values ($T_1$, $T_2$, $T_3$) is within the range of periods $T_e$ of the wave excitation.

2. Floating system according to claim 1 characterized in that at least one of the said natural periods T1 or T2 or T3 is at least greater than 7 seconds.

3. Floating system according to claim 1 characterized in that the said tensioned line or lines are aligned in an approximately vertically direction.

4. Floating system according to claim 1 characterized in that the said tensioned line or lines make an angle at least equal to 10° in relation to the vertical. direction.

5. Floating system according to claim 1 characterized in that the floating structure is a marine platform for production and/or drilling or a buoy located at a distance "d" below the surface of the water.

6. Floating system according to claim 5 characterized in that the said marine platform is used for water at least deeper than 1000 m.

7. Floating system according to claim 1 characterized in that the said tensioned line or lines are made of high-strength carbon fibre.

8. Floating system according to claim 1 characterized in that the said tensioned line or lines are made of steel cable with high mechanical strength.

9. Floating system according to claim 1 characterized in that the said tensioned line or lines (2) possess geometric characteristics such as section $S_i$ and/or diameter $D_i$, at least one of the two characteristics being determined so that stresses $\sigma_i$, taking into account the dynamic amplification factor FAD, exercised on the said tensioned line or lines are less than a maximum fixed stress $\sigma_{max}$.

10. Floating system according to claim 1 characterized in that at least one of said natural periods $T_1$ or $T_2$ or $T_3$ is greater than 4 seconds inclusive.

11. Floating system according to claim 1 characterized in that at least one of said natural periods $T_1$ or $T_2$ or $T_3$ is between 7 and 12 seconds inclusive.

12. Floating system according to claim 1, characterized in that the said tensioned line or lines make an angle between 10° and 45° inclusive in relation to the vertical.

* * * * *